US005934137A

United States Patent [19]

Tarpill

[11] Patent Number: 5,934,137

[45] Date of Patent: Aug. 10, 1999

[54] COMPRESSION ASSEMBLY TOOL

[75] Inventor: Andrew J. Tarpill, East Haddam, Conn.

[73] Assignee: Capewell Components Company, Crowmwell, Conn.

[21] Appl. No.: 09/074,895

[22] Filed: May 8, 1998

[51] Int. Cl.[6] ..... H01R 43/042

[52] U.S. Cl. ..... 72/409.14; 29/751; 29/282

[58] Field of Search ..... 72/409.13, 409.14, 72/409.01, 409.19, 412, 453.16; 29/237, 751, 753

[56] References Cited

U.S. PATENT DOCUMENTS

| | | | |
|---|---|---|---|
| 2,333,120 | 11/1943 | Parker | 29/84 |
| 2,852,841 | 9/1958 | Ballard et al. | 29/508 |
| 3,094,774 | 6/1963 | Nazarow et al. | 29/203 |
| 3,226,968 | 1/1966 | Holmes | 72/409.16 |
| 3,757,408 | 9/1973 | Shemtov | 29/237 |
| 3,793,693 | 2/1974 | Levak | 29/203 |
| 4,136,549 | 1/1979 | Lytle et al. | 72/453.16 |
| 4,345,361 | 8/1982 | Baumann | 29/237 |
| 4,483,056 | 11/1984 | Schwalm et al. | 29/237 |
| 4,509,244 | 4/1985 | Houck et al. | 29/516 |
| 4,559,691 | 12/1985 | Mannhart et al. | 29/283.5 |
| 4,589,271 | 5/1986 | Laux | 72/409.01 |
| 4,794,780 | 1/1989 | Battenfeld | 72/410 |
| 4,932,091 | 6/1990 | Krzyzanski | 7/107 |
| 5,040,288 | 8/1991 | Nilsson | 29/751 |
| 5,105,648 | 4/1992 | Steiner et al. | 72/410 |
| 5,113,474 | 5/1992 | Slaney et al. | 385/136 |
| 5,138,864 | 8/1992 | Tarpill | 72/410 |
| 5,392,508 | 2/1995 | Holliday et al. | 29/751 |
| 5,435,167 | 7/1995 | Holliday et al. | 72/410 |
| 5,596,800 | 1/1997 | Holliday et al. | 29/751 |
| 5,647,119 | 7/1997 | Bourbeau | 72/409.14 |

OTHER PUBLICATIONS

Augat Communications Division LRC Product, Installation & Product Data Handbook; LRC Electronics, Inc. Box 111, Horseheads, NY 14845,6/92,5M; pp. 1–123 plus cover page, Jun. 1992.

New Product Release–PT–5000 Pocket Terminx®, The Cutting Edge, Cable Prep Cable TecExpo Edition Issue 5, Spring 1997.

Compression Tool, Broadband Systems & Design, a Gordon Publication, Apr. 1997, vol. 3, No. 3.

Compression Tool, Communications Technology, A CT Publications Product, Sep. 1996.

Terminx®, The Next Generation In Cable Termination Tools, Cable Prep.

*Primary Examiner*—Daniel C. Crane
*Attorney, Agent, or Firm*—DeLio & Peterson, LLC

[57] ABSTRACT

A compression assembly tool for attaching a connector to an end of a cable by compressing the connector axially uses a light rigid O-frame. The handle is spring loaded to the open position, but is held in the closed position by a wire bail for storage. A pair of split base supports having annular bearing surfaces for supporting the back of the connector over a full 360 degrees are pivotally attached to the body and closed by a spring. The split base supports are easily opened by pressing on push surfaces to pivot them to the open position. The split base supports have stops to bring them positively into the correct alignment with the axis of compression when the split base supports are closed.

18 Claims, 1 Drawing Sheet

COMPRESSION ASSEMBLY TOOL

BACKGROUND OF THE INVENTION

1. Field of the Invention

This invention relates to tools for attaching connectors to coaxial cables by compressing the connector in a direction parallel to the axis of the cable.

2. Description of Related Art

Coaxial cable is widely used to carry radio and television signals, digital data and the like. A major user of coaxial cable is the cable television industry which uses coaxial cable to carry the signal from a central location to each subscriber.

To make the many connections required for the cable television network requires the installation of numerous coaxial cable connectors. To avoid any interruption in service, it is critical that the connectors be applied properly. Many problems with poor signal quality that require expensive service calls are the result of a connector that was initially installed incorrectly.

Coaxial cable connectors come in a variety of designs, but one relatively recent design is a coaxial cable connector which is secured to the prepared end of the coaxial cable by compressing the connector in a direction that is parallel to the longitudinal axis of the coaxial cable.

Various types of connectors which are attached in this way have been designed. One design includes a collapsible compressible ring which collapses inwardly to secure the connector and make the connection when the connector is compressed axially. Another design uses a front and rear half for the connector which slidingly engage when the connector is compressed axially. These types of axial compression connectors can be contrasted with earlier designs wherein the compression was applied radially inward to collapse a portion of the connector and make the connection between the connector and the coaxial cable.

Within the general category of axial compressed connectors, there are a wide variety of different types of connectors. Each connector may have a slightly different compression distance necessary to fully compress the connector. However, in all designs, it is essential that the connector be fully compressed to ensure that the connection is secure.

To achieve a reliable connection, and in order to provide the force required, a hand tool is used to compress the connector. One problem with prior art tools is the failure of the tool to hold the back half of the connector in alignment with, and squarely perpendicular to, the plunger portion of the tool which provides the compression force. When correct alignment is not maintained, the connector will not be compressed properly. At the same time, it is desirable to keep the hand tool light in weight and inexpensive to manufacture.

Heretofore, compression tools have used a C-shaped frame comprising a back and two legs. In a C-frame design the open portion of the frame defines a compression region within which the connector is positioned. A plunger projects into the compression region through one leg of the C-frame, and the connector is supported against a parallel bearing surface on the opposite leg of the C-frame. The back portion of the C-frame is relied upon and must be strong enough to hold the two legs parallel to each other.

In order to keep the front of the connector square relative to the back of the connector, the back and two legs of the C-frame must be relatively large and strong, making them relatively heavy. Otherwise the frame will distort as the compression forces are applied. Such distortion lets the two legs of the C-frame move away from parallel resulting in an improperly compressed connector that may fail. The present invention addresses this problem through the use of an O-frame which permits a reduction in weight and materials cost, while improving tool rigidity.

Another problem with prior art designs relates to coaxial alignment of the back half of the connector relative to the compression plunger. Even if the plane of the bearing surface upon which the back of the connector is supported remains perpendicular to the axis of the plunger, prior art devices have failed to ensure that the axis of the coaxial cable and the back half of the connector remain aligned with the axis of the compression plunger driving the front half of the connector.

Some early designs for axial compression tools, for example, of the type seen in U.S. Pat. No. 5,435,167 provided only partial support via a U-support for the back of the connector. This allowed the back of the connector to rock out of alignment during the compression operation. Performance is significantly improved through the introduction of the applicant's design incorporating a pair of split base supports which completely encircle the cable and provide a full 360° bearing surface for supporting the back of the connector around its entire parameter. This design may be seen in the applicant's co-pending patent application U.S. Ser. No. 08/733,261, now abandoned, which is incorporated herein by reference.

This design for 360° encircling support has been widely adopted in the industry and reduces the problem with ensuring alignment between the front half and the back half of the connector. However, previous implementations of the 360° encircling support design, have allowed the two split base halves to rotate on their pivot relative to the frame of the tool, even after they are closed. This permits the center of the 360° encircling support to wander away from the axis of the compression plunger even though the bearing surface defined by the split base halves remains perpendicular to the axis of the plunger. This misalignment also results in an improperly compressed connector. The present invention addresses this problem through the use of an integral stop on the split base portions which positions them positively in alignment relative to the axis of the compression plunger.

A further problem with prior art split base 360° support members has been the awkwardness of removing the cable from the encircling halves of the bearing support on the split base portions. If the split base portions close tightly and accurately with a relatively high spring pressure (as is desired for maintaining the alignment and retention of the cable during the compression operation), it is difficult to open the two split base portions to extract the cable from between them.

This problem has been addressed in the present invention through the use of a pair of push surfaces which are located on a side opposite the pivot point of the two split base portions to provide a simple rocker action opening as used in a clothes pin or alligator clip.

Yet another problem with prior art devices relates to the interconnection between the handle providing the compression force and the plunger performing the compression. Typically, as the handles are opened, the plunger is pulled towards the retracted position by a link. Some prior art designs have locked into the open position when the handles open too far and the link passes over center. The present invention addresses this difficulty with an enlarged plunger head which limits rearward motion of the plunger.

A further problem with prior art tools has been the need to use two hands to operate the tool. In such tools, the handle must be manually pulled outward to the open position before it can be squeezed to the compression position. The present invention addresses this difficulty through the use of a spring which automatically opens the handle and a bail which latches the handle in the closed position for storage.

Another difficulty has been the problem with adjusting the compression distance between the compression plunger and the bearing surface on the split base portion. This distance must be maintained and adjusted to compensate for wear and/or to accommodate connectors of different designs. Prior art tools have been awkward to adjust, and misadjusted compression tools result in poor connector attachment. The present invention addresses this difficulty through the use of a simple adjustment and method of locking the adjustment in position, coupled with a gage block which allows the operator to feel the adjustment and turn the adjusting portion of the tool while the gauge block is within the compression region.

Bearing in mind the problems and deficiencies of the prior art, it is therefore an object of the present invention to provide a compression assembly tool for axially compressing electrical connectors onto coaxial cables which is light in weight, has low material cost, and is not subject to distortion during the compression operation.

It is another object of the present invention to provide a compression assembly tool which allows the cable and compressed connector to be easily removed from the tool after the connector is compressed.

A further object of the invention is to provide a compression tool which maintains the axis of the co-axial cable in accurate alignment with the axis of the plunger.

It is yet another object of the present invention to provide a tool which is easy to use and which opens automatically, but which can be stored in the closed position.

A further object of the present invention is to provide a design which can be easily adjusted to high accuracy.

SUMMARY OF THE INVENTION

The above and other objects and advantages, which will be apparent to those skilled in the art, are achieved in the present invention which is directed to, in a first aspect, a compression assembly tool for attaching a connector to an end of a cable including a body having an open portion defining a compression region for receiving the end of the cable and the connector. A lever handle is pivotally attached to the body and a plunger is mounted for longitudinal sliding motion relative to the body. The plunger is driven by the lever handle between an extended position to compress the connector when the connector is in the compression region and a retracted position to remove the connector from the compression region.

A pair of split base supports are pivotally attached to the body for motion between an open position and a closed position. Each split base support has an annular bearing surface and at least one of the split base supports has a stop surface for contacting the body. A spring urges the split base supports towards the closed position. The annular bearing surfaces encircle the cable in the closed position and provide support for an end of the connector opposite the plunger during compression. The annular bearing surfaces release the cable when the split base supports are in the open position and the stop surface contacts the body to hold the annular bearing surfaces in alignment with the plunger when the split base supports are in the closed position.

In the preferred embodiment the plunger includes a plunger tip having threads engaged in the plunger. The plunger tip is longitudinally adjustable by rotation relative to the plunger to thread the tip into and out of the plunger. A gage block is provided which includes a first gage surface that contacts the annular bearing surfaces on the split base supports and a second gage surface which contacts the plunger tip. A central opening extends from the first gage surface to the second gage surface. The central opening has a diameter sufficient to receive a tool, preferably an Allen wrench, to rotate and adjust the plunger tip.

The plunger is locked into the adjusted position by a locking screw and a locking pad. The locking screw is threadedly engaged into the plunger transversely to the plunger tip. The locking pad is located between the locking screw and the threads of the plunger tip and is formed of a resilient material for gripping and protecting the threads of the plunger tip when the locking screw is tightened.

In the most highly preferred embodiment of the invention, the body has an O-frame which is both light and rigid. In this embodiment, the split base supports include push surfaces extending outward from opposed side surfaces of the body when the split base supports are in the closed position; and the split base supports pivot to the open position when the push surfaces are urged towards the side surfaces of the body.

The handle includes a handle spring mounted between the body and the lever handle for urging the lever handle away from the body, and a releasable handle lock holds the lever handle towards the body when the tool is not in use.

BRIEF DESCRIPTION OF THE DRAWINGS

The features of the invention believed to be novel and the elements characteristic of the invention are set forth with particularity in the appended claims. The figures are for illustration purposes only and are not drawn to scale. the invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–4 of the drawings in which like numerals refer to like features of the invention.

Figure 1:
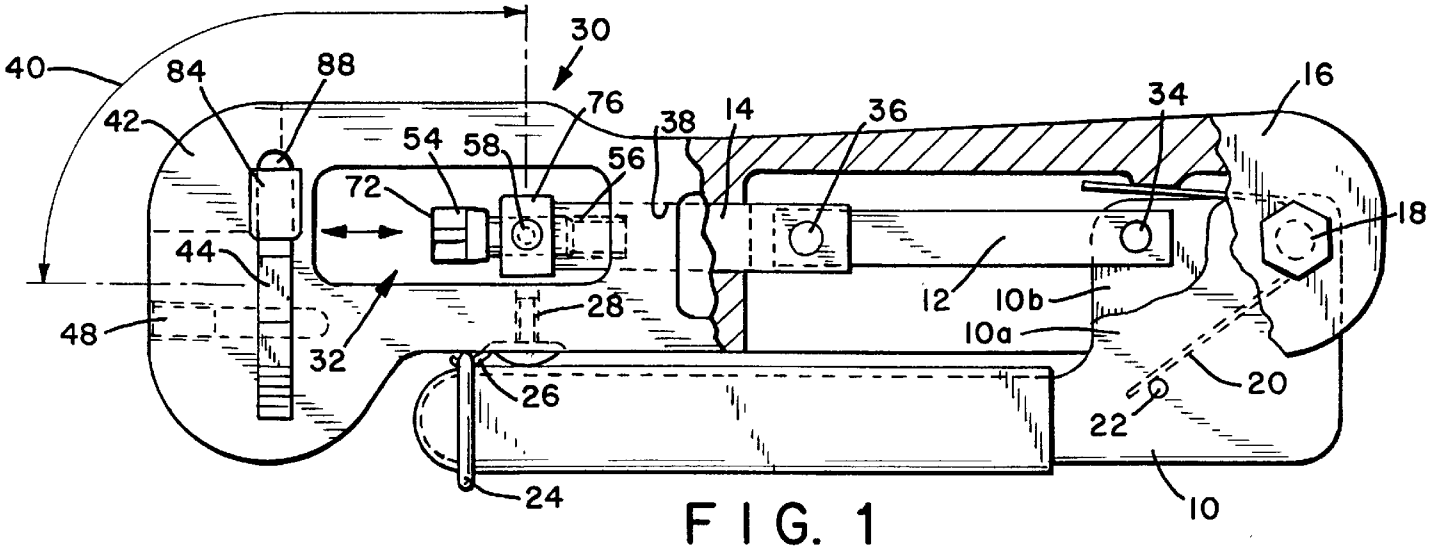
FIG. 1 is a side elevational view of the compression assembly tool of the present invention, partly shown in section.

Referring to FIG. 1, the compression assembly tool of the present invention comprises a lever handle 10 connected to a link 12 driving a plunger 14. The lever handle 10 is formed as a pair of side plates 10*a* and 10*b* with the link 12 pivoting partially therebetween. The lever handle 10 is pivotally attached to a body 16 via pivot 18. A torsion spring 20 acts between the body 16 and a pin 22 extending between the side plates 10*a,* 10*b* to urge the lever handle away from the body 16 when it is not restrained.

FIG. 1 shows the handle being held close to the body with the plunger 14 in the extended position. It is retained in this position by means of a releasable handle lock formed by bail wire 24. The bail wire 24 is mounted to the body via retainer 26 and screw 28 which allow it to rotate and unlatch the handle to pivot away from the body.

The tool body 16 includes an O-frame portion generally indicated with reference no. 30 which defines a compression region 32. As the handle 10 pivots around pivot 18 away from the body, link 12 pivots on pivots 34 and 36 and draws the plunger 14 to the retracted position (toward the right in FIG. 1). As the handle closes, link 12 drives the plunger 14 to the extended position toward the left in FIG. 1 and compresses a connector located in the compression region.

Figure 4:
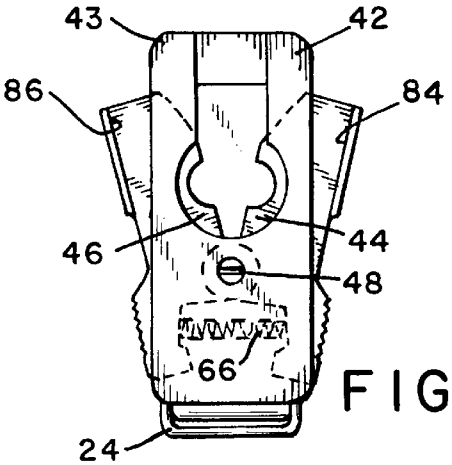
FIG. 4 is a front elevational view of the compression assembly tool corresponding to FIG. 3 except the split base portions are shown in the open position.
Figure 3:
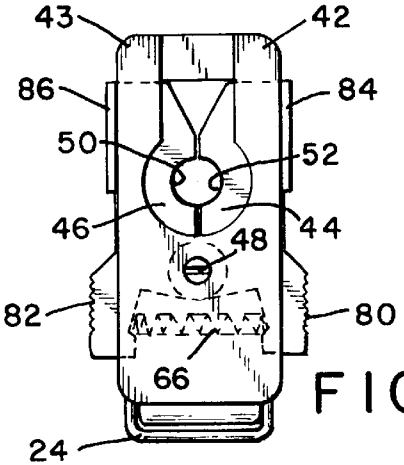
FIG. 3 is a front elevational view of the compression assembly tool in FIG. 1 seen from the left of FIG. 1 showing the split base portion in the closed position.

The O-frame portion 30 of the body 16 is substantially solid along the right side. A bore 38 extends through this solid portion, and plunger 14 slides within this bore. The bore 38 maintains the plunger in constant axial alignment as it moves between the extended and retracted positions. The body is also solid on the lower half of the O-frame in the vicinity of bale retaining member 26 and screw 28. However, as can be seen in FIGS. 3 and 4, the O-frame is divided into two opposed sidewalls 42, 43 and is open along the entire left upper quadrant indicated with reference no. 40. This allows the coaxial cable and connector to be inserted into the compression region 32 between the sidewalls 42, 43.

With the lever handle 10 moved away from the body, and the plunger 14 in the retracted position, a cable and connector can be placed into the compression region 32 by inserting it between opposed sidewalls 42, 43. The cable is pressed between a pair of split base portions 44, 46. The split base portions pivot around pivot 48 to the open position seen in FIG. 4 allowing the cable to be encircled by annular bearing portions 50, 52 on the inner perimeter of the split base portions 44, 46 directly opposite the plunger 14. The diameter of the opening formed by the bearing portions when in the closed position is sufficiently large to accept a coaxial cable, but is smaller than the diameter of the back end of the connector to be compressed.

As the handle is squeezed toward the body, the plunger 14 moves towards the bearing surfaces 50, 52 compressing the connector. The split base portions 44, 46 are supported by the O-frame and particularly by the sidewalls 42 and 43. The thickness of the solid lower portion of the O-frame in the vicinity of element 26, can be reduced as compared to prior art devices which do not include the O-frame design and which do not include the sidewalls 42 and 43 which stiffen the O-frame against any distortion during the compression cycle. This allows the weight of the tool to be reduced without compromising rigidity and also allows a reduction in material cost.

To ensure that the distance between the plunger 14 and the plane defined by the bearing surfaces 50, 52 is correct, the plunger 14 is provided with an adjustable plunger tip 54 which is threadedly engaged via threads 56 into the end of plunger 14. A locking screw 58 allows the plunger tip 54 to be locked into position. A locking pad formed of a resilient material, such as plastic, is positioned in the threaded bore holding the locking screw 58 between the tip of the locking screw and the threads 56 of plunger tip 54. The locking pad allows locking screw 58 to exert sufficient force against threads 56 to prevent them from turning while also protecting them from damage.

The locking screw 58 is preferably an Allen screw adjustable by an Allen wrench, and plunger tip 54 is preferably adjustable by inserting an Allen wrench along its axis into the head of the plunger tip. The plunger tip can then be rotated to adjust its position relative to the plunger 14 and split bases 44 and 46.

Figure 2:
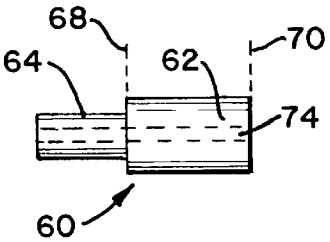
FIG. 2 is a side elevational view of a gage block for use in combination with the tool of the present invention in order to provide accurate adjustment.

FIG. 2 shows a gage block 60 having two cylindrical portions 62 and 64. Gage block portion 62 has a diameter which is larger than the diameter of the bearing surfaces 50, 52 when closed. Gage block portion 64 has a diameter approximately the same as a coaxial cable. To adjust the tool, locking screw 58 is loosened which decreases pressure on the locking pad (not shown) located between the tip of locking screw 58 and the threads of the plunger tip 54. Gage block portion 64 is inserted into the compression region between the encircling bearing support portions 50, 52. The split base portions 44, 46 are allowed to close under the force of closing spring 66 (see FIG. 3).

Gage block portion 60 defines two parallel gage surfaces 68, 70. The distance between those gage surfaces accurately corresponds to the desired distance between the annular bearing surfaces 50, 52 on the split base portions and the tip 72 on the plunger tip 54. Different gage blocks may be used for different types of connectors to be compressed.

With the gage block 60 in position, the handle 10 is fully closed and an Allen wrench is inserted through central opening 74 in gage block 60 and into the plunger tip 54. The plunger tip can then be rotated with the Allen wrench until surface 72 on the plunger tip is accurately flush against surface 70 on the gage block. Locking screw 58 is then tightened with the same Allen wrench and adjustment is complete. Because the gage block does not block access to the adjustment and locking screws this adjustment process is significantly better than prior art designs. Such designs required repetitive cycles of removal of the gage block to make adjustments, followed by reinsertion of the gage block to check the change made.

The locking screw 58 is threaded into an enlarged end 76 in plunger 14. This enlarged end provides material for the threads holding locking screw 58, and also acts to prevent the plunger 14 from moving too far to the right in the retracted position. In some prior art devices lacking this feature, the handles can be inadvertently locked open when they are opened too far, causing the link between the handles and the plunger to move over center. Such over center locking cannot occur in this design.

Referring to FIG. 3, it can be seen that the split base portions 44, 46 each include a corresponding push surface 80, 82. When these push surfaces are squeezed together towards the sidewalls of the body, spring 66 is compressed and the split base portions pivot from the closed position (seen in FIG. 3) to the open position (seen in FIG. 4) allowing a cable and connector to be inserted into the compression region. Prior art designs have not provided any method for conveniently opening the jaws. The convenience of this system allows spring 66 to be relatively strong which is advantageous in securely holding the cable and the attached connector in the correct aligned position.

Another feature provided by the split base supports is positive alignment of the axis of the opening formed by bearing surfaces 50, 52 with the centerline of the plunger 14. As can be seen best in FIG. 1, the split base portions each include a stop surface 84, 86 composed of a portion of the split base portion which is larger in diameter than the slot 88 within which the split base portions pivot. In the preferred design, the stop plates 84, 86 prevent the split base portions from pivoting into slot 88. Spring 66 can be relatively strong and the dimensions of the split base portions are such that stop surface 84 and stop surface 86 are exactly flush to the outer sides of the O-frame (as shown in FIG. 3) just as the encircling bearing support portions 50, 52 touch.

This structure provides an exact self-centering operation with a relatively strong spring 66 which securely positions the back end of the connector. Due to push surfaces 80, 82 and the simple press-to-open design, the strength of spring 66 does not interfere with removal of the cable after the compression operation.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A compression assembly tool for attaching a connector to an end of a cable comprising:

a body having an open portion defining a compression region for receiving the end of the cable and the connector;

a lever handle pivotally attached to the body;

a plunger mounted for longitudinal sliding motion relative to the body, the plunger being driven by the lever handle between an extended position to compress the connector when the connector is in the compression region and a retracted position to remove the connector from the compression region;

a pair of split base supports pivotally attached to the body for motion between an open position and a closed position, each split base support having an annular bearing surface and at least one of the split base supports having a stop surface for contacting the body; and a spring for urging the split base supports towards the closed position;

the annular bearing surfaces encircling the cable in the closed position and providing annular bearing support for an end of the connector opposite the plunger during compression, the annular bearing surfaces releasing the cable when the split base supports are in the open position;

the stop surface contacting the body to hold the annular bearing surfaces in alignment with the plunger when the split base supports are in the closed position.

2. A compression assembly tool according to claim 1 wherein the plunger includes a plunger tip having threads engaged in the plunger, the plunger tip being longitudinally adjustable by rotation relative to the plunger.

3. A compression assembly tool according to claim 2 in combination with a gage block, the gage block including:

a first gage surface adapted to contact the annular bearing surfaces on the split base supports;

a second gage surface adapted to contact the plunger tip; and a central opening extending from the first gage surface to the second gage surface, the central opening having a diameter sufficient to receive a tool to rotate and adjust the plunger tip.

4. A compression assembly tool according to claim 2 wherein the plunger includes a locking screw and a locking pad for locking the plunger tip, the locking screw being threadedly engaged into the plunger transversely to the plunger tip, the locking pad being located between the locking screw and the threads of the plunger tip and being formed of a resilient material for gripping and protecting the threads of the plunger tip when the locking screw is tightened.

5. A compression assembly tool according to claim 1 wherein the body comprises an O-frame.

6. A compression assembly tool according to claim 1 wherein:

the body includes a pair of opposed side surfaces;

the split base supports include push surfaces extending outward from the opposed side surfaces of the body when the split base supports are in the closed position; and the split base supports pivot to the open position when the push surfaces are urged towards the side surfaces of the body.

7. A compression assembly tool according to claim 1 wherein the split base supports are identical and are pivotally attached to the body via a common pivot.

8. A compression assembly tool according to claim 1 further including:

a handle spring mounted between the body and the lever handle for urging the lever handle away from the body; and a releasable handle lock for holding the lever handle towards the body when the tool is not in use.

9. A compression assembly tool according to claim 8 wherein the releasable handle lock is a wire bail.

10. A compression assembly tool according to claim 1 further comprising a link connected between the lever handle and the plunger, the link having a first end pivotally connected to the lever handle and a second end pivotally connected to the plunger.

11. A compression assembly tool according to claim 1 wherein the plunger includes an enlarged plunger head for restricting retracted motion of the plunger.

12. A compression assembly tool for attaching a connector to an end of a cable comprising:

a body having a pair of opposed side surfaces and an open portion defining a compression region for receiving the end of the cable and the connector;

a lever handle pivotally attached to the body;

a plunger mounted for longitudinal sliding motion relative to the body, the plunger being driven by the lever handle between an extended position to compress the connector when the connector is in the compression region and a retracted position to remove the connector from the compression region;

a pair of split base supports pivotally attached to the body for motion between an open position and a closed position, each split base support having an annular bearing surface and a push surface extending outward from one of the side surfaces of the body; and a spring for urging the split base supports towards the closed position, the split base supports pivoting to the open position when the push surfaces are pushed towards the side surfaces of the body;

the annular bearing surfaces encircling the cable when the split base supports are in the closed position and providing annular bearing support for an end of the connector opposite the plunger during compression, the annular bearing surfaces releasing the cable when the split base supports are in the open position; and wherein at least one of the split base supports has a stop surface for contacting the body, the stop surface holding the annular bearing surfaces in alignment with the plunger when the split base supports are in the closed position.

13. A compression assembly tool according to claim 12 wherein the split base supports are identical and are pivotally attached to the body via a common pivot.

14. A compression assembly tool for attaching a connector to an end of a cable in combination with a gage block, the compression assembly tool including:

a body having a pair of opposed side surfaces and an open portion defining a compression region for receiving the end of the cable and the connector;

a lever handle pivotally attached to the body;

a plunger mounted for longitudinal sliding motion relative to the body, the plunger being driven by the lever handle between an extended position to compress the connector when the connector is in the compression region and a retracted position to remove the connector from the compression region;

a pair of split base supports pivotally attached to the body for motion between an open position and a closed position, each split base support having an annular bearing surface and a push surface extending outward from one of the side surfaces of the body; and a spring for urging the split base supports towards the closed position, the split base supports pivoting to the open position when the push surfaces are pushed towards the side surfaces of the body;

the annular bearing surfaces encircling the cable when the split base supports are in the closed position and providing annular bearing support for an end of the connector opposite the plunger during compression, the annular bearing surfaces releasing the cable when the split base supports are in the open position; and wherein the plunger includes a plunger tip having threads engaged in the plunger, the plunger tip being longitudinally adjustable by rotation relative to the plunger;

the gage block including:

a first gage surface adapted to contact the annular bearing surfaces on the split base supports;

a second gage surface adapted to contact the plunger tip; and a central opening extending from the first gage surface to the second gage surface, the central opening having a diameter sufficient to receive a tool to rotate and adjust the plunger tip.

15. A compression assembly tool for attaching a connector to an end of a cable comprising:

a body having a pair of opposed side surfaces and an open portion defining a compression region for receiving the end of the cable and the connector;

a lever handle pivotally attached to the body;

a plunger mounted for longitudinal sliding motion relative to the body, the plunger being driven by the lever handle between an extended position to compress the connector when the connector is in the compression region and a retracted position to remove the connector from the compression region;

a pair of split base supports pivotally attached to the body for motion between an open position and a closed position, each split base support having an annular bearing surface and a push surface extending outward from one of the side surfaces of the body; and a spring for urging the split base supports towards the closed position, the split base supports pivoting to the open position when the push surfaces are pushed towards the side surfaces of the body;

the annular bearing surfaces encircling the cable when the split base supports are in the closed position and providing annular bearing support for an end of the connector opposite the plunger during compression, the annular bearing surfaces releasing the cable when the split base supports are in the open position; the plunger including a plunger tip having threads engaged in the plunger, the plunger tip being longitudinally adjustable by rotation relative to the plunger and; wherein the plunger includes a locking screw and a locking pad for locking the plunger tip, the locking screw being threadedly engaged into the plunger transversely to the plunger tip, the locking pad being located between the locking screw and the threads of the plunger tip and being formed of a resilient material for gripping and protecting the threads of the plunger tip when the locking screw is tightened.

16. A compression assembly tool according to claim 15 wherein the plunger includes an enlarged plunger head for restricting retracted motion of the plunger and the locking screw is threadedly engaged into the enlarged plunger head.

17. A compression assembly tool for attaching a connector to an end of a cable comprising:

a body having an "O" frame defining a compression region for receiving the end of the cable and the connector, the compression region having a compression axis, and the "O"-frame including a front portion and a back portion connected by a pair of legs, the front and back portions extending generally parallel to the compression axis;

a lever handle pivotally attached to the body;

a plunger mounted for longitudinal sliding motion relative to the body along the compression axis, the plunger being driven by the lever handle between an extended position to compress the connector when the connector is in the compression region and a retracted position to remove the connector from the compression region; and a pair of split base supports pivotally attached to the body for motion between an open position and a closed position, each split base support having an annular bearing surface, the annular bearing surfaces encircling the cable in the closed position and providing annular bearing support for an end of the connector opposite the plunger during compression, the annular bearing surfaces releasing the cable when the split base supports are in the open position.

18. A compression assembly tool for attaching a connector to an end of a cable comprising:

a body having a pair of opposed side surfaces and an "O" frame defining a compression region for receiving the end of the cable and the connector;

a lever handle pivotally attached to the body;

a plunger mounted for longitudinal sliding motion relative to the body, a link connected between the lever handle and the plunger, the plunger being driven by the lever handle through the link between an extended position to compress the connector when the connector is in the compression region and a retracted position to remove the connector from the compression region; and a pair of split base supports pivotally attached to the body for motion between an open position and a closed position, each split base support having an annular bearing surface and a push surface extending outward from one of the side surfaces of the body, at least one of the split base supports having a stop surface for contacting the body, and;

a spring for urging the split base supports towards the closed position;

the annular bearing surfaces encircling the cable and providing annular bearing support for an end of the connector opposite the plunger during compression, the stop surface contacting the body to hold the annular bearing surfaces in alignment with the plunger when the split base supports are in the closed position, and the split base supports pivoting to the open position when the push surfaces are pushed towards the side surfaces of the body to release the cable.

* * * * *